US005992934A

United States Patent [19]

Gehrig et al.

[11] Patent Number: 5,992,934

[45] Date of Patent: Nov. 30, 1999

[54] DEVICE FOR ADJUSTING THE FORCIBLY COUPLED SEAT AND BACK OF A DENTIST CHAIR

[75] Inventors: Hermann Gehrig, Martinstal; Günther Moritz, Lampertheim, both of Germany

[73] Assignee: Sirona Dental Systems GmbH & Co. KG, Bensheim, Germany

[21] Appl. No.: 09/077,401

[22] PCT Filed: Nov. 15, 1996

[86] PCT No.: PCT/DE96/02180

§ 371 Date: Dec. 15, 1998

§ 102(e) Date: Dec. 15, 1998

[87] PCT Pub. No.: WO97/19666

PCT Pub. Date: Jun. 5, 1997

[30] Foreign Application Priority Data

Nov. 29, 1995 [DE] Germany ..... 195 44 545

[51] Int. Cl.[6] ..... A47C 1/024

[52] U.S. Cl. ..... 297/316; 297/320; 297/330; 297/354.13

[58] Field of Search ..... 297/316, 320, 297/354.12, 354.13, 330, 340

[56] References Cited

U.S. PATENT DOCUMENTS

| | | | |
|---|---|---|---|
| 3,578,379 | 5/1971 | Talor | 297/316 |
| 3,866,973 | 2/1975 | Heubeck | 297/316 |
| 3,873,152 | 3/1975 | Garas | 297/330 |
| 4,572,573 | 2/1986 | Yoshikawa et al. | 297/330 |
| 4,988,145 | 1/1991 | Engel . | |
| 5,015,035 | 5/1991 | Stoeckl et al. . | |

FOREIGN PATENT DOCUMENTS

| | | |
|---|---|---|
| 0 248 418 | 12/1987 | European Pat. Off. . |
| 0 373 245 | 6/1990 | European Pat. Off. . |
| 2 627 968 | 9/1989 | France . |
| 2 671 702 | 7/1992 | France . |
| 30 18 684 | 11/1981 | Germany . |

*Primary Examiner*—Anthony D. Barfield
*Attorney, Agent, or Firm*—Hill & Simpson

[57] ABSTRACT

A mechanism is presented for the constraint-coupled adjustment of seat and backrest of a dental patient chair, whereby the seat-side end of the backrest is guided in a curved guide of the seat carrier, and whereby the seat carrier is pivotably connected to an upper part around a backrest-proximate tilting axis that, given an inclination of the backrest, the seat carrier with seat and leg support is tilted back around the tilting axis and, conversely, is tilted forward when the backrest is raised up. Inventively, a flexible, bendable force transmission element is provided for the constraint-coupling that has its one end secured to the upper part and has its other end secured to the seat-side end of the backrest. The force transmission element is guided over at least one roller in the fashion of a block and pulley and thus produces an adjustment motion effected by constraint-coupling of backrest and seat. A chain that is guided over chain rollers is advantageously provided as force transmission element.

5 Claims, 2 Drawing Sheets

DEVICE FOR ADJUSTING THE FORCIBLY COUPLED SEAT AND BACK OF A DENTIST CHAIR

The invention is directed to a dental patient chair having a mechanism for the constraint-coupled adjustment of seat and backrest of the chair. The mechanism includes a seat carrier or frame which is connected to an upper part for pivotable movement around a backrest proximate axis so that when the backrest is inclined backwards, the seat carrier with a seat and leg support is tilted upward around the backrest proximate axis and when the backrest is raised upward, the carrier is tilted downward.

A patient chair having such a mechanism is disclosed, for example, by European Letters Patent 0 373 245. Even though the mechanism disclosed therein allows the seat to be brought into a relatively low limit position, the parts provided for the inclination of the backrest and for tilting the seat relative to the upper part occupy a relatively large space.

DE-A1 3 018 684 discloses another patient chair wherein the seat support is divided into a seat part carrying the buttocks and thighs and a calf support arranged pivotable relative to the seat part. So that the calf support can be designed short and pivoted down into a vertical position when the seat part is lowered far, the calf support contains a support part that can be telescopically extended and retracted in its longitudinal direction. The support part is adjusted along the calf support with the assistance of a cable that is arranged in the fashion of a block and pulley and runs over three rollers when it is adjusted with the assistance of an actuating drive that acts between seat part and calf support.

SUMMARY OF THE INVENTION

The invention is based on the object of creating a mechanism of the species initially cited that allows a lower, flatter structure of the seat overall, particularly of the seat carrier. The improvement in the mechanism comprises the backrest at a lower end adjacent the seat being guided in a curved guide which is provided in the seat carrier and a flexible, bendable force transmission element has one end secured to a first fastening point on the upper part and another end secured to the backrest at a second fastening point adjacent the lower end, the transmission element is guided over three rollers in the fashion of a block and pulley with a first roller being mounted at a projection on the seat carrier to form a first variable spacing between the first fastening point and the first roller, the second roller mounted on the upper part adjacent the lower end of the backrest to form a second variable spacing between the second roller and the second fastening point and the third roller being mounted on the upper part spaced from the second roller toward the first roller so that a shortening of the first spacing causes a lengthening of the second spacing and vice versa.

The inventive constraint-coupling of seat and backrest is advantageously achieved with a roller chain and three chain wheels, whereby the one chain wheel represents the "loose roller" of the "inverse block and pulley" and the two other chain wheels merely serve for the deflection of the chain force.

The overall arrangement is advantageously undertaken so that the backrest is inclined approximately twice as fast as the seat is tilted. This is achieved in that, as a result of the arrangement in the fashion of a block and pulley, the adjustment paths and, thus, the adjustment rates between the fastening points of the force transmission element, for example the roller chain, at the seat-side or lower end of the backrest on the one hand and at the upper part on the other hand are brought into a specific relationship relative to one another. The aforementioned motion relationship can be achieved on the basis of the selection of the spacings.

Other advantages and objects of the invention will be readily apparent from the following description of the preferred embodiments, the drawings and claims.

DESCRIPTION OF THE PREFERRED EMBODIMENT

Figure 1:
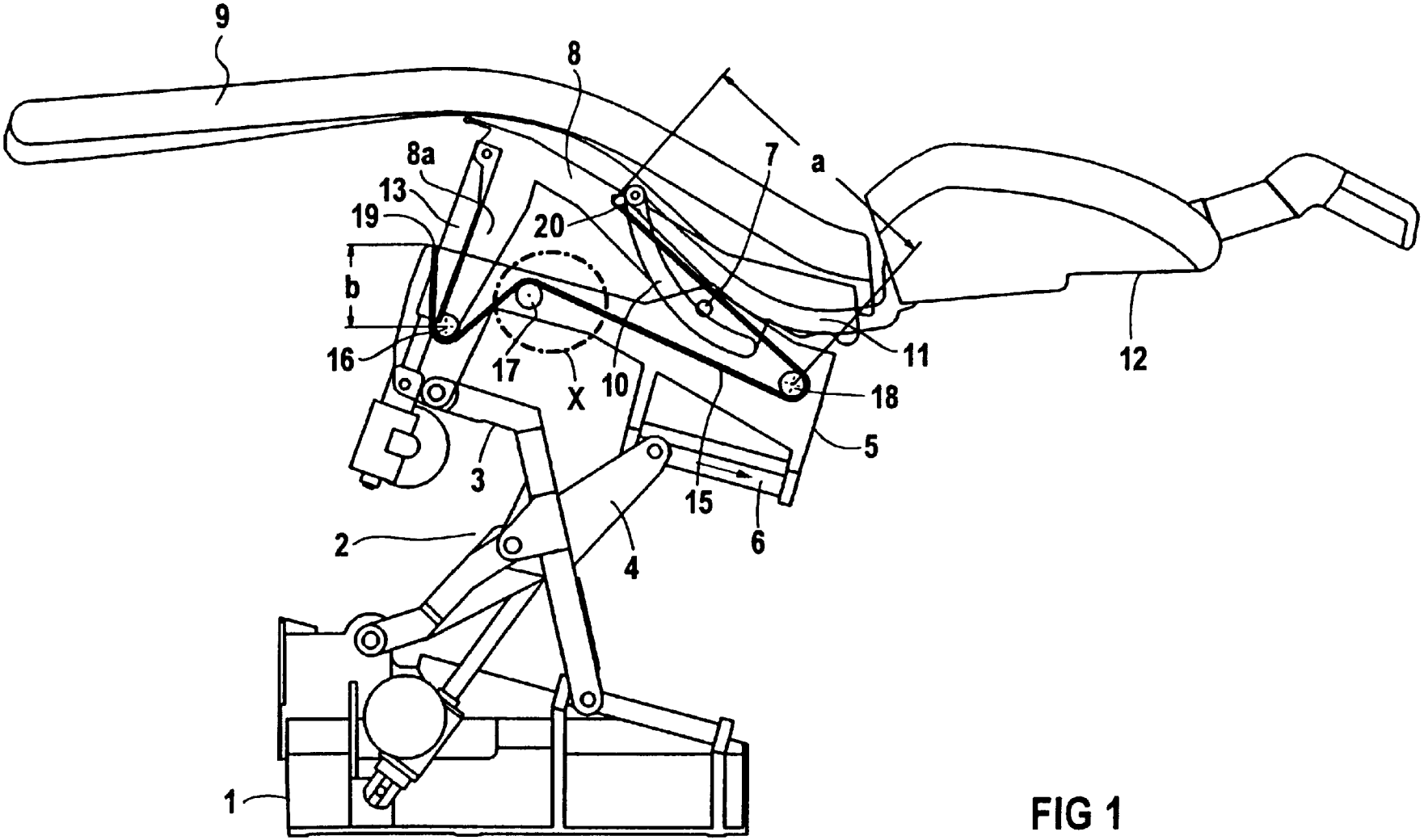
FIG. 1 is a schematic view with portions removed for purposes of illustration of a dental patient chair in a position that corresponds to a lying position of a patient and a standing position of an attendant with, the upper part of the chair in the highest position.

The patient chair shown in FIG. 1 contains a base part 1 with a height adjustment means 2 designed scissors-like. Since this is disclosed in greater detail in the initially cited EP-B1-0 373 245, this need not be explained in detail here. Let it be merely noted that the one (3) of the two upper carrying arms 3, 4 is coupled to an upper part referenced 5, whereas the other (4) is guided in a slideway 6 displaceable in arrow direction. The same is also true of the two lower arm ends.

A seat carrier 8 is tiltably coupled by tilting bearings 7 to the upper part 5 which is fashioned in the form of an open box. The seat and leg support 9 is rigidly connected to the seat carrier 8. The seat carrier 8 also contains a curved guide 10 in which the end-face, lower end part 11 of the backrest 12, often referred to as a "sword" in the technical jargon, is guided.

An adjustment mechanism 13 is located at a distanced from the tilt point 7. The adjustment mechanism 13 is coupled, on the one hand, to the upper part 5 and, on the other hand, to the seat carrier 8 and effects a tilting of the seat around the tilting axis 7. As shown, the adjustment mechanism 13 can be an electromotive spindle drive; it is also conceivable and lies within the scope of the invention to alternatively provide a hydraulic or pneumatic drive.

A mechanism that effect [sic] a constraint-coupled adjustment of the seat and leg support 9 and of the backrest 12 of the chair is provided between upper part 5 and the end part 11. The mechanism is composed of a bendable, flexible force transmission element 15 and three guide rollers 16 through 18 that act in the fashion of a block and pulley. The force transmission element 15 is secured to a fixed point 19 at the upper part 5 and to a fixed point 20 at the backrest sword or end part 11. The two rollers 17 and 18 serve as guide rollers and are seated stationary at the upper part 5, whereas the roller 16 represents the "loose roller" of the block and pulley and, for this purpose, is seated at the lower end of a fork-like continuation 8*a* of the seat carrier 8.

Figure 2:
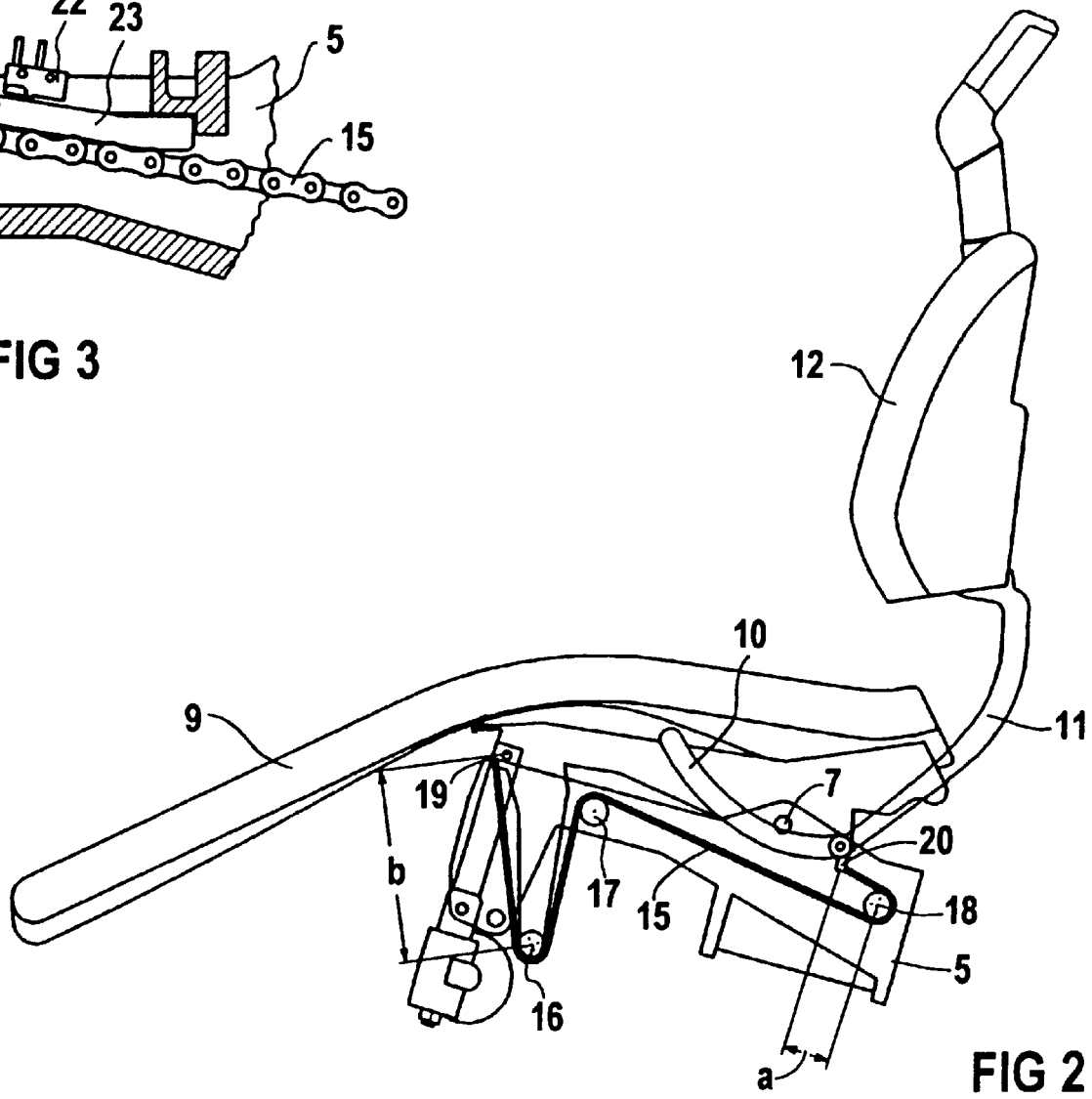
FIG. 2 is a side view of the upper chair part with the backrest in a erect position and the mechanism for the lower chair part not shown.

The functioning is now explained proceeding from the seated position shown in FIG. 2. Given the position shown in FIG. 2, the backrest 12 is in an erect position. Seat and leg support 9 is in a typical seated position wherein the seat is tilted slightly toward the front and the leg support is directed obliquely down. In this position, a distance a is present between the fastening point 20 and the guide roller 18. A distance b is present at the other end of the force transmission element between the fastening point 19 and the loose roller 16.

When the attending person would now like to move the patient into a lying position, then it is desirable that the backrest 12 is inclined faster than the seat and leg support 9 is tilted. Advantageously, the backrest 12 should be inclined approximately twice as fast as the seat and leg support 9 is tilted.

The adjustment motion is initiated by activating the adjustment mechanism 13. In the case of the electromotive spindle drive shown here, the motor pushes the nut tube up via a spindle. The seat carrier 8 is thereby tilted around the tilting axis 7. The roller 16 moves upward relative to the upper part 5 and the force transmission element 15 guided around this roller is tautened by the dead weight of the backrest 12 and of the sword 11. As a result of the relationship of the rollers to form a block and pulley, the fastening point 20 moves at about twice the speed as the upward motion of the roller 16 and allows the sword 11, guided by the curved guide 10, to slide into the seat carrier 8 until the lying position shown in FIG. 1 has been reached.

A roller chain can be especially advantageously employed as the force transmission element 15 and the three rollers 16 through 18 are then fashioned as chain wheels. Alternatively, a toothed belt with corresponding crown gears, a flat belt or V-belt or a cable pull with correspondingly fashioned rollers can be utilized.

A particular development of the invention provides that the parts 15 through 18 be doubly provided, i.e., for example, two roller chains and six chain wheels. Advantageously, the chain wheels are then arranged in pairs on a common shaft. The arrangement is thereby undertaken such that the one chain of the chains arranged next to one another and running independently of one another is implemented slightly longer than the other. As a result thereof, only one of the two chains is loaded; the somewhat longer chain runs along without load as a safety chain. If the load chain were to break for some reason or other, the second, safety chain takes effect. At the same time, a safety chain switch 22 is activated by the break of the load chain, and the electronics of the chair, particularly the adjustment drive 13, are shut off by the switch 22.

Figure 3:
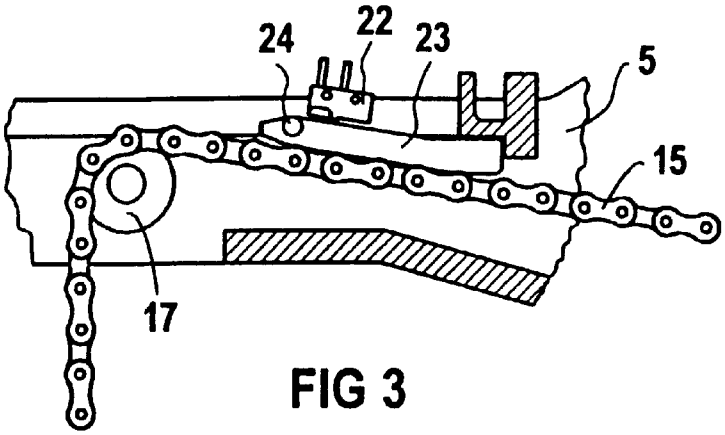
FIG. 3 is an enlarged view of the portion contained in the circle X of FIG. 1.

FIG. 3 shows the safety switch 22 as a detail in a magnified view. In the normal case, the force transmission element 15, i.e., for example, the roller chain, is stretched taut. It is conducted over a sliding pad 23 that is tiltably seated at a pivot point 24 on the upper part 5. When the backrest 12 collides with an article, the sword 11 is pulled slightly out of the seat carrier 8; the chain would no longer be stretched taut. The sliding pad lying on the chain is tilted and thus activates the chain switch 22 that in turn shuts off the chair electronics.

We claim:

1. A dental patient chair having a mechanism for the constraint-coupled adjustment of seat and backrest of the chair, said mechanism including a seat carrier being coupled to an upper part tiltable around a backrest-proximate tilting axis so that, given an inclination of the backrest, the seat carrier with a seat and leg support will be tilted back around the tilting axis and, conversely, will be tilted forward when the backrest is raised up, the improvement comprising a seat-side end of a backrest being guided in a curved guide of the seat carrier, a flexible, bendable force transmission element being provided and having one end secured to a first fastening point at the upper part and with another end secured to a second fastening point at the seat-side end of the backrest, said element being guided over three rollers in the fashion of a block and pulley, with a first roller being seated on a continuation of the seat carrier and with the first fastening point of the force transmission element forming a first, variable spacing (b) with the first roller, the second roller being seated at the backrest-side end of the upper part and forms a second variable spacing (a) with the second fastening point of the force transmission element at the end part of the backrest, and the third roller being a deflection roller mounted on the upper part, whereby an arrangement is undertaken such that a shortening of the first spacing (b) leads to a lengthening of the second spacing (a) and vice versa.

2. A dental patient chair according to claim 1, wherein the spacings (a) and (b) are dimensioned such that a shortening of the first spacing (b) leads to a lengthening of the second spacing (a) in the ratio of approximately 1:2.

3. A dental patient chair according to claim 1, wherein a safety switch is coupled to the force transmission element, said safety switch being arranged such that it interrupts an adjustment drive for the seat and/or height adjustment means when the force transmission element is not stretched taut.

4. A dental patient chair according to claim 1, wherein the transmission element and the rollers are provided in duplicate, whereby, in the one arrangement, the force transmission element is implemented slightly longer and is therefore not stretched taut compared to the element in the other arrangement.

5. A dental patient chair according to claim 1, wherein a roller chain is provided as the force transmission element, and chain wheels are provided as three rollers.

* * * * *